US006202586B1

(12) United States Patent
Askestad et al.

(10) Patent No.: US 6,202,586 B1
(45) Date of Patent: Mar. 20, 2001

(54) ANCHOR

(75) Inventors: Sigmund Askestad, Sætre; Knut Haldorsen, Nesbru, both of (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 09/308,561

(22) PCT Filed: Nov. 10, 1997

(86) PCT No.: PCT/NO97/00296

§ 371 Date: Aug. 23, 1999

§ 102(e) Date: Aug. 23, 1999

(87) PCT Pub. No.: WO98/22334

PCT Pub. Date: May 28, 1998

(30) Foreign Application Priority Data

Nov. 20, 1996 (NO) ..... 964931

(51) Int. Cl.[7] ..... B63B 21/30
(52) U.S. Cl. ..... 114/294
(58) Field of Search ..... 114/294, 295, 114/296, 300; 405/224

(56) References Cited

U.S. PATENT DOCUMENTS

| | | | | |
|---|---|---|---|---|
| 1,305,507 | * | 6/1919 | Froger | 114/294 |
| 2,556,279 | * | 6/1951 | Johnson | 114/294 |
| 3,431,879 | | 3/1969 | Westling | 114/206 |
| 3,496,900 | | 2/1970 | Mott et al. | 114/206 |
| 3,823,563 | * | 7/1974 | Lovie | 405/224 |
| 4,155,673 | | 5/1979 | Yashima . | |
| 4,697,958 | * | 10/1987 | Kenny, Sr. | 114/295 |
| 4,710,061 | * | 12/1987 | Blair et al. | 405/224 |

FOREIGN PATENT DOCUMENTS

| | | |
|---|---|---|
| 2 227 988 | 8/1990 | (GB) . |
| 90/10755 | 9/1990 | (WO) . |

* cited by examiner

*Primary Examiner*—Sherman Basinger
(74) *Attorney, Agent, or Firm*—Wenderoth, Lind & Ponack, L.L.P.

(57) ABSTRACT

An anchor for anchoring floating structures at sea, in particular floating platforms for the production of oil and/or gas. The anchor includes a hollow body (2) which is designed to be submerged in a sea bed by suction or by some other method. The anchor is characterized in that the body is a polygon with concave side surfaces.

10 Claims, 5 Drawing Sheets

The force equilibrium
of the corner c*b=p*a

ANCHOR

BACKGROUND OF INVENTION

The present invention concerns an anchor for anchoring submarine structures, such as pipes, and floating structures at sea, in particular floating platforms for the production of oil and/or gas. The anchor comprises a hollow body which is designed to be submerged in the sea bed by means of suction or by some other means.

Circular suction anchors, so-called bucket anchors, of the above type are known in the prior art. Such bucket anchors have a large volume and large end surfaces which mean that the anchor has a large dynamic weight during the installation phase.

During the suction phase, the shell of the bucket anchor is subject to instability. This applies, in particular, to installations where there are large anchor forces and where the soil is weak. Bucket anchors with a very great diameter are required here, which means that the shell must be built with a very thick plate. This results in the weight of the steel itself being very great. Together with the enormous dynamic additional force which arises on account of the resonating, confined water and the resonating quantity of water at the ends, this results in the requirements made of the installation vessel being very strict where size, stability, winch power and other conditions are concerned.

The known type of bucket anchor solution is thus expensive to construct and to install.

SUMMARY OF THE INVENTION

The present invention represents an anchor solution which is much lighter, has a lower dynamic additional force when the anchor is installed, and thus has substantially lower construction and installation costs, but which still has an anchoring capacity (anchoring force) which is at least as great as that of the bucket anchor.

The present invention is characterized in that the anchor body consists of a polygon with concave side surfaces.

BRIEF DESCRIPTION

The present invention will be described in further detail in the following by means of examples and with reference to the following drawings.

DETAILED DESCRIPTION OF THE INVENTION

Figure 1:
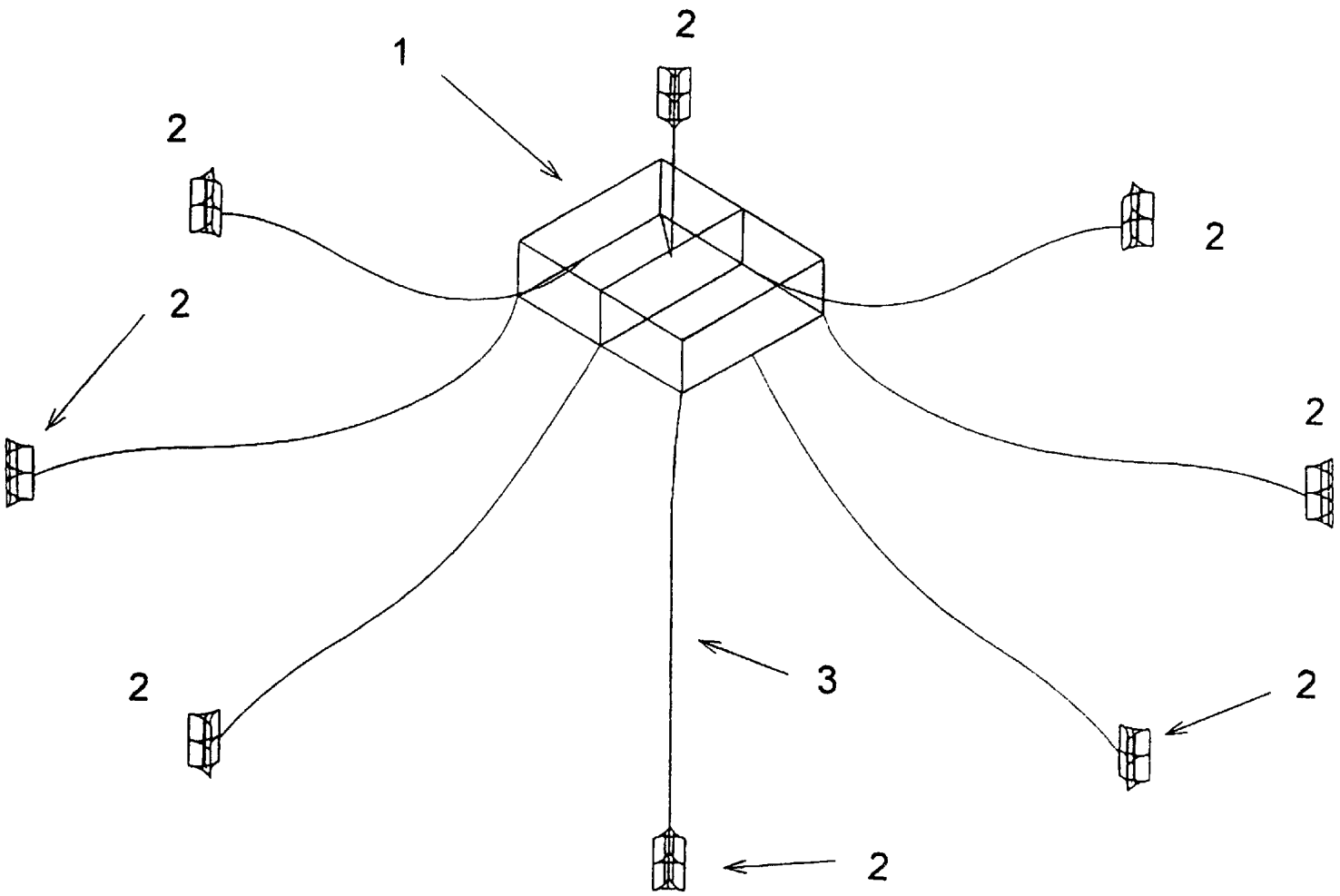
FIG. 1 shows a perspective diagram of a platform which is anchored with anchors in accordance with the present invention.

FIG. 1 shows, as stated, a perspective diagram of a platform 1 which is anchored, via anchor lines 3, to anchors 2 in accordance with the present invention.

Figure 2:
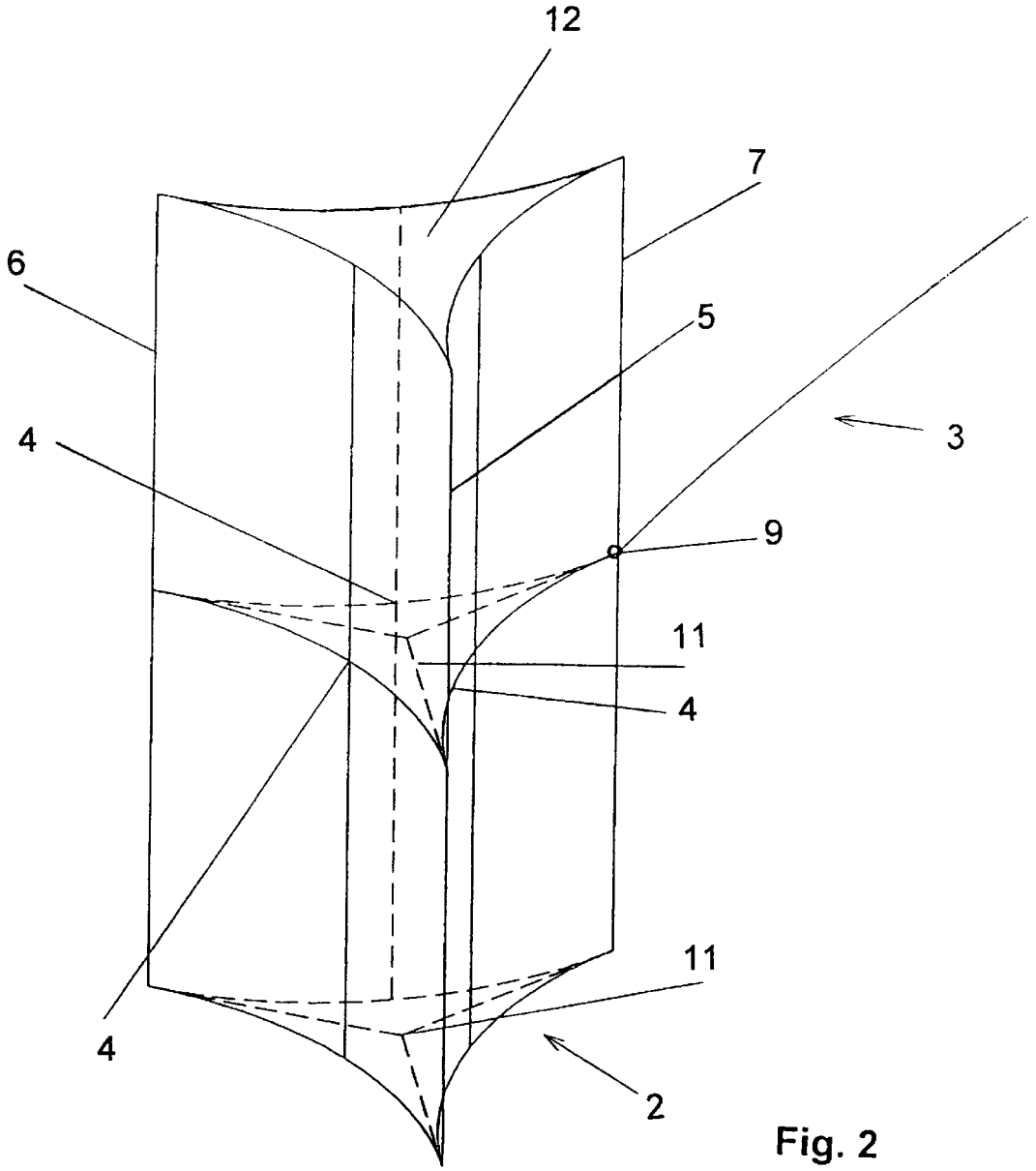
FIG. 2 shows a perspective enlarged view one of the anchors shown in FIG. 1.

As shown in FIG. 2, the anchor 2 is, in the example shown here, triangular (star-shaped) with concave (curved) side surfaces 4, but with straight generants and corners 5, 6 and 7 which are aligned in the vertical direction of the anchor. An anchor which is designed for suction is fitted with a top plate 12, whereas an anchor which is lowered (knocked) into the soil in another way is appropriately open at both ends.

Figure 3:
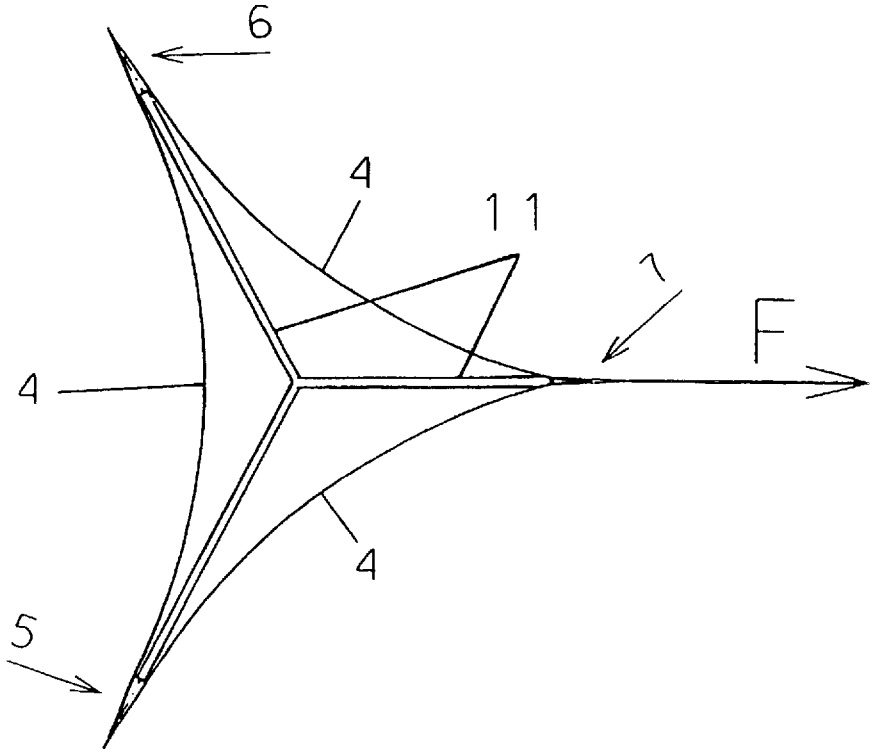
FIG. 3 shows a horizontal sectional view of the anchor shown in FIG. 2 with a force arrow "F" which indicates the tensile force and the direction for the anchor line.
Figure 3:
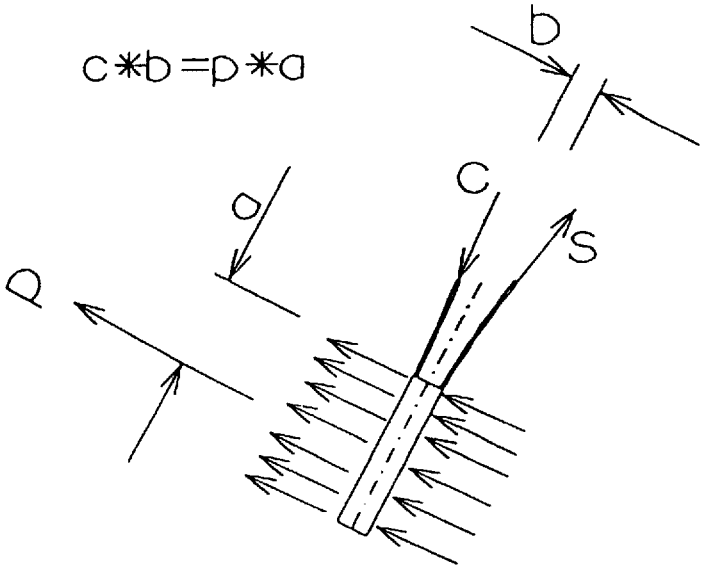

FIG. 3 shows a horizontal section of the anchor shown in FIG. 2 with a force arrow "F" which indicates the tensile force and its direction for the anchor line.

The side surfaces 4 meet at corners 5, 6 and 7, which are preferably without eccentricity (see, in particular, FIG. 4) so that no bending moments occur around the corners. The corners 5, 6 and 7 can be formed most easily by welding the side surfaces 4 directly to each other but should preferably, as shown in the figure, be formed by welding the side surfaces 4 to a hollow section in the form of a square section, tubular section or possibly plain bar.

The corner 7, which also forms the fixing point for the anchor line 3, should be provided with a reinforced part (not shown in detail), preferably a thicker plate, in the area of a fixing eye 9 (see FIG. 2) for the line 3.

Figure 4:
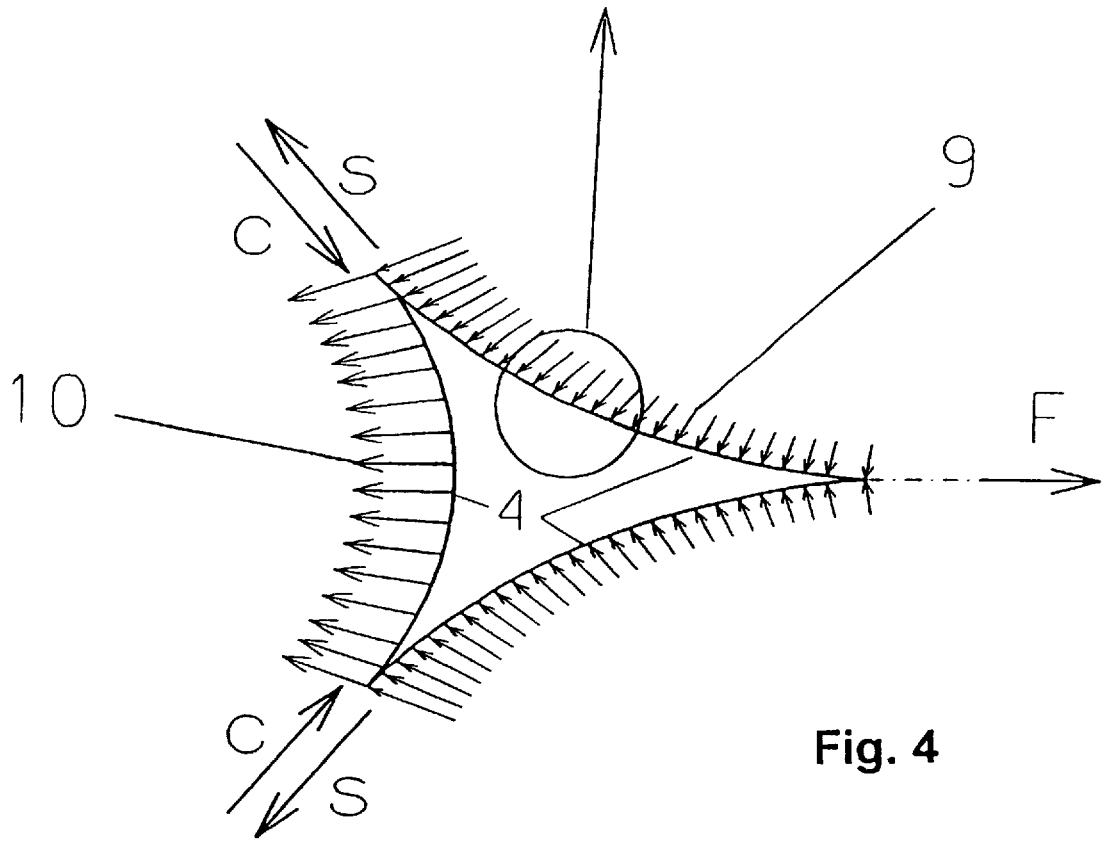
FIG. 4 is a schematic diagram which shows how the anchor constructed in accordance with the present invention is subjected to load in the operating state.

FIG. 4 shows, in principle, how the anchor is subjected to load in the operating state. The tension in the front side surfaces 4, represented by "S" in FIG. 4, balances the compressive forces in the side surfaces while the pressure represented by "C" supports the compressive forces which act along the rear surface 4. By giving the side surfaces and the rear surface a curvature relative to the loads along the sides, an equilibrium is achieved between these two forces in the corners without the corners being subject to major shearing. The plates are preferably so soft that, if the pressure is anything other than that assumed, the corners will assume a different position until a new equilibrium is achieved.

The pressure in the side surfaces is thus in equilibrium with the tension, the membrane stresses in the plates, without large bending stresses being created. The principle of membrane stresses occurring without bending stresses is due to the curved shape of the side surfaces and contributes to allowing the thickness of the material to be made very thin in comparison with a similar anchor with straight sides so that the weight of the anchor is reduced accordingly.

The design of the present invention with curved side surfaces also contributes to better force transmission from the anchor line as the forces are mainly absorbed as tensile and compressive forces in the side surfaces (membrane stresses). With a bucket anchor, the force transmission from the anchor line will also result in large bending stresses.

The size of a suction anchor, designed for a floating platform in the North Sea, with curved sides in accordance with the present invention can be 10–15 meters in height (depth) and 8–10 meters for the width of the side surfaces. For a pile anchor, the height could be 15–20 meters, while the width of the side surfaces could be 4–6 meters.

Figure 5:
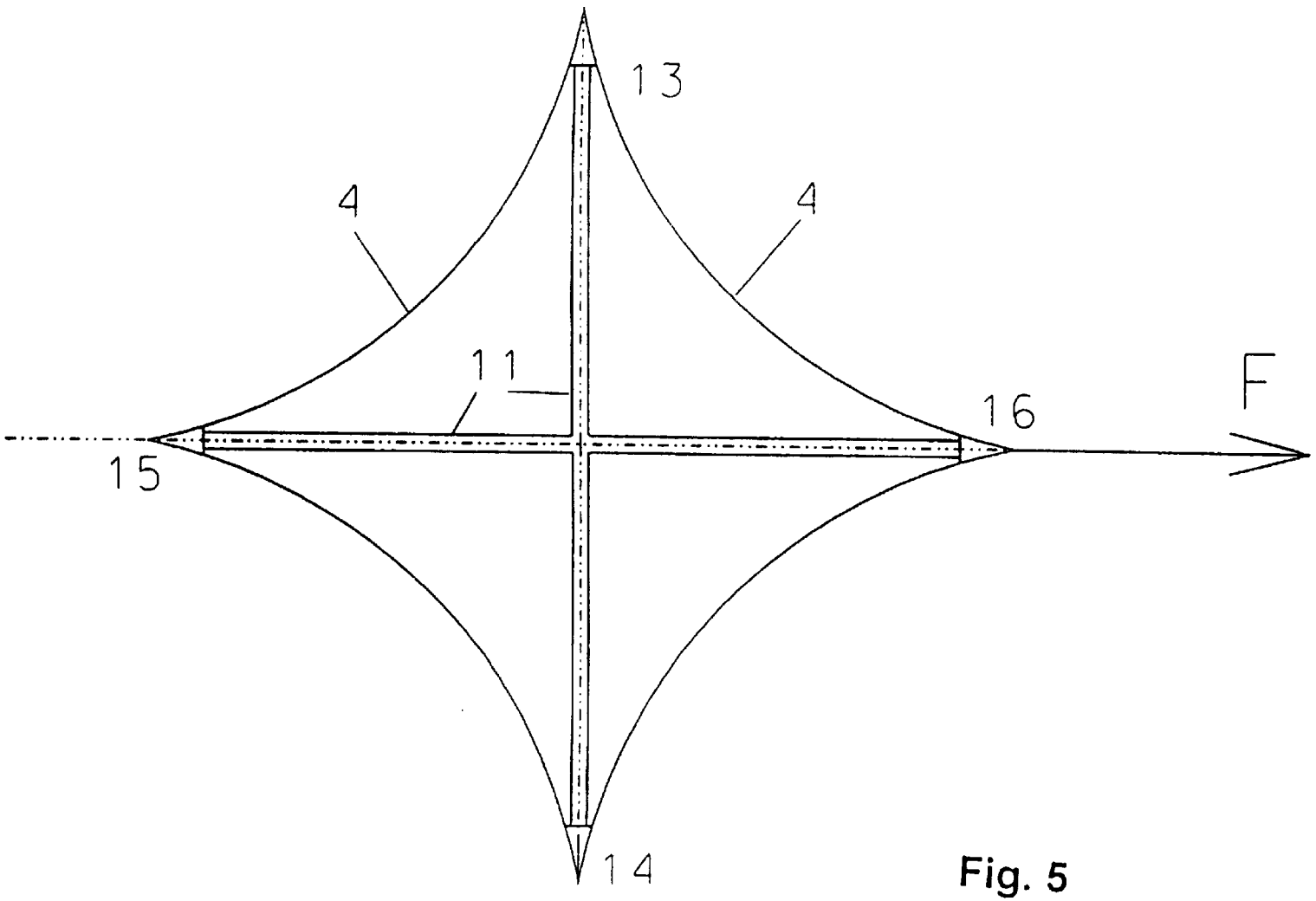
FIG. 5 shows an alternative design of an anchor in accordance with the present invention.

FIG. 5 shows an alternative design of an anchor in accordance with the present invention which is provided with four side surfaces. However, it should be noted that the present invention, as it is described in the above and shown in the figures, is not restricted to anchors with three or four side surfaces, but can in reality also be used for anchors with any number of sides.

Note, an anchor constructed in accordance with the present invention with three side surfaces as shown in FIG. 3 will, in an operational situation, i.e. when it has been submerged sufficiently in the bed, be "self-supporting" in the sense that it is not necessary to have any cross-stays or reinforcements in addition to that which is mentioned above concerning the fixing eye for the anchor line. When used as a suction anchor and depending on the quality of the soil (bed), it may, however, be necessary to have a center bulkhead or stay 11, for example at the lower insertion end of the anchor to prevent it from contracting or changing shape dramatically. Under normal operating conditions, after the anchor has been submerged in the bed, the stays will not, however, fulfil any function.

For an anchor with four side surfaces, as shown in FIG. 5, stays connecting corners 13, 14 and 15, 16 respectively will be necessary in connection with suction of the anchor, while during operation the anchor will actually only require stays which connect corners 15 and 16 to maintain a force equilibrium for the corners.

The advantage of the shape of an anchor with four or more corners is that it allows for side surfaces with greater curvature, which increases the strength of the anchor in cases in which the anchor has to be pressed up again (suction anchor), for example in the event of incorrect positioning.

What is claimed is:

1. An anchor for anchoring floating structures at sea, said anchor comprising a hollow body adapted to be submerged in a sea bed, said hollow body defining a polygon having a plurality of sides interconnected at a plurality of corners, wherein each of said sides defines an outer concave side surface, and a fixing eye, connected to said hollow body, for attaching an anchor line.

2. An anchor for anchoring floating structures at sea, said anchor comprising a hollow body adapted to be submerged in a sea bed, said hollow body defining a polygon having a plurality of sides interconnected at a plurality of corners, wherein each of said sides defines an outer concave side surface, and wherein said hollow body has a closed upper end, and an open lower end.

3. An anchor as claimed in claim 1, wherein said corners are parallel to each other, and each of said outer concave surfaces extends from an upper end of said hollow body.

4. An anchor for anchoring floating platforms for the production of oil and/or gas, said anchor comprising:

a hollow body adapted to be submerged in a sea bed, said body defining a polygon having a plurality of sides that are interconnected at a plurality of corners, wherein each of said sides defines an outer concave side surface; and an anchor line fixing eye connected to one of the corners of said hollow body.

5. An anchor as claimed in claim 4, wherein each of said sides has opposite longitudinal edges, and each of said edges is welded directly to an edge of an adjacent one of said sides at a corner of said hollow body.

6. An anchor as claimed in claim 4, wherein each of said sides has opposite longitudinal edges, and each of said edges are connected to one of the edges of another one of said sides at a corner of said hollow body.

7. An anchor as claimed in claim 4, wherein said anchor is a suction anchor, and said hollow body has a closed upper end.

8. An anchor as claimed in claim 4, further comprising a plurality of stays disposed in said hollow body, wherein each of said stays extends from a corner of said hollow body, and said stays are connected to each other at a center axis of said hollow body.

9. An anchor as claimed in claim 4, wherein said hollow body has a closed upper end, and an open lower end.

10. An anchor as claimed in claim 4, wherein said corners are parallel to each other, and each of said outer concave surfaces extends from an upper end to a lower end of said hollow body.

* * * * *